US011007100B2

(12) United States Patent
Tarakanova

(10) Patent No.: US 11,007,100 B2
(45) Date of Patent: May 18, 2021

(54) SYSTEMS AND METHODS FOR POSITIONING A PATIENT IN A BED

(71) Applicant: Elizavetha Tarakanova, Chesterfield, MO (US)

(72) Inventor: Elizavetha Tarakanova, Chesterfield, MO (US)

(73) Assignee: TREDBED, LLC, Chesterfield, MO (US)

( * ) Notice: Subject to any disclaimer, the term of this patent is extended or adjusted under 35 U.S.C. 154(b) by 84 days.

(21) Appl. No.: 16/123,883

(22) Filed: Sep. 6, 2018

(65) Prior Publication Data

US 2019/0070053 A1 Mar. 7, 2019

Related U.S. Application Data

(60) Provisional application No. 62/554,882, filed on Sep. 6, 2017.

(51) Int. Cl.
*A61G 7/10* (2006.01)
*A61G 7/057* (2006.01)

(52) U.S. Cl.
CPC ..... *A61G 7/1026* (2013.01); *A61G 7/1034* (2013.01); *A61G 7/05761* (2013.01)

(58) Field of Classification Search
CPC . A61G 7/1026; A61G 7/1034; A61G 7/05761
See application file for complete search history.

(56) References Cited

U.S. PATENT DOCUMENTS 4,939,798 A * 7/1990 Last ..... E04H 4/101 4/502
5,400,448 A * 3/1995 Zwickey ..... A61G 1/04 128/870
6,363,555 B1 * 4/2002 LaRose ..... A61G 7/1032 5/488
6,629,323 B2 * 10/2003 Sverdlik ..... A61G 7/1015 5/81.1 C
7,111,338 B2 9/2006 Faux et al.
7,293,303 B2 * 11/2007 Worrell ..... A61G 7/1032 5/81.1 HS
8,257,285 B2 * 9/2012 Cook ..... A61H 1/005 601/46
8,745,779 B2 6/2014 Roberg
9,003,578 B2 * 4/2015 Hillenbrand, II .... A61G 7/1026 5/488
9,173,798 B2 * 11/2015 Hillenbrand, II .... A61G 7/1026
9,205,012 B2 * 12/2015 Hillenbrand, II .... A61G 7/1026
9,333,139 B2 10/2016 Hillenbrand et al.
2003/0110559 A1 * 6/2003 Weigand ..... A61G 7/1044 5/81.1 R
2005/0217023 A1 * 10/2005 Tally ..... A61G 7/1032 5/81.1 HS
2012/0144581 A1 * 6/2012 Roberg ..... A61G 7/1026 5/81.1 C

* cited by examiner

*Primary Examiner* — Robert G Santos
*Assistant Examiner* — Rahib T Zaman
(74) *Attorney, Agent, or Firm* — Armstrong Teasdale LLP

(57) ABSTRACT

A system for repositioning a patient in a bed includes an overlay that is positioned between the patient and the bed mattress. The overlay is wound around a roller that rotates to pull the overlay and the patient to a more upright position on the bed after the patient has slid down the bed. The roller is rotated either manually by a crank or automatically by a motor that is operable using a switch and/or a plurality of sensors.

18 Claims, 13 Drawing Sheets

SYSTEMS AND METHODS FOR POSITIONING A PATIENT IN A BED

CROSS-REFERENCE TO RELATED APPLICATIONS

This application is a non-provisional application and claims priority to U.S. Provisional Patent Application Ser. No. 62/554,882 filed Sep. 6, 2017, for "SYSTEMS AND METHODS FOR POSITIONING A PATIENT IN A BED", which is hereby incorporated by reference in its entirety.

BACKGROUND

The field of the disclosure relates generally to patient positioning on an incline bed, and more specifically, to methods and systems for holding or repositioning a patient on an incline bed.

One known problem within health care is the tendency for patients to slide down their beds when the beds are in an inclined position. Some patients are required to be in an inclined position and others prefer such a position for comfort. However, after some period of time, patients tend to slide down toward the foot of the bed. In some patients, moving from an inclined position to a flatter position may pose health risks. For example, a patient may be more likely to develop pneumonia or have other respiratory problems if not propped up into an inclined position.

Some patients may not be able to move themselves back into an inclined position. In such cases, a nurse may be forced to maneuver the patient back toward the head of bed. Such repositioning by the nurse may result in injury to one or both of the nurse or the patient.

As such, what is needed is a system that holds and/or repositions patients in the incline position on a bed without risk of injury to the patient or health care workers.

BRIEF DESCRIPTION

A system for repositioning a patient in a bed includes an overlay that is positioned between the patient and the bed mattress. The overlay is wound around a roller that rotates to pull the overlay and the patient to a more upright position on the bed after the patient has slid down the bed. The roller is rotated either manually by a crank or automatically by a motor that is operable using a switch and/or a plurality of sensors. The features, functions, and advantages that have been discussed can be achieved independently in various implementations or may be combined in yet other implementations, further details of which can be seen with reference to the following description and drawings.

DETAILED DESCRIPTION

Figure 1:
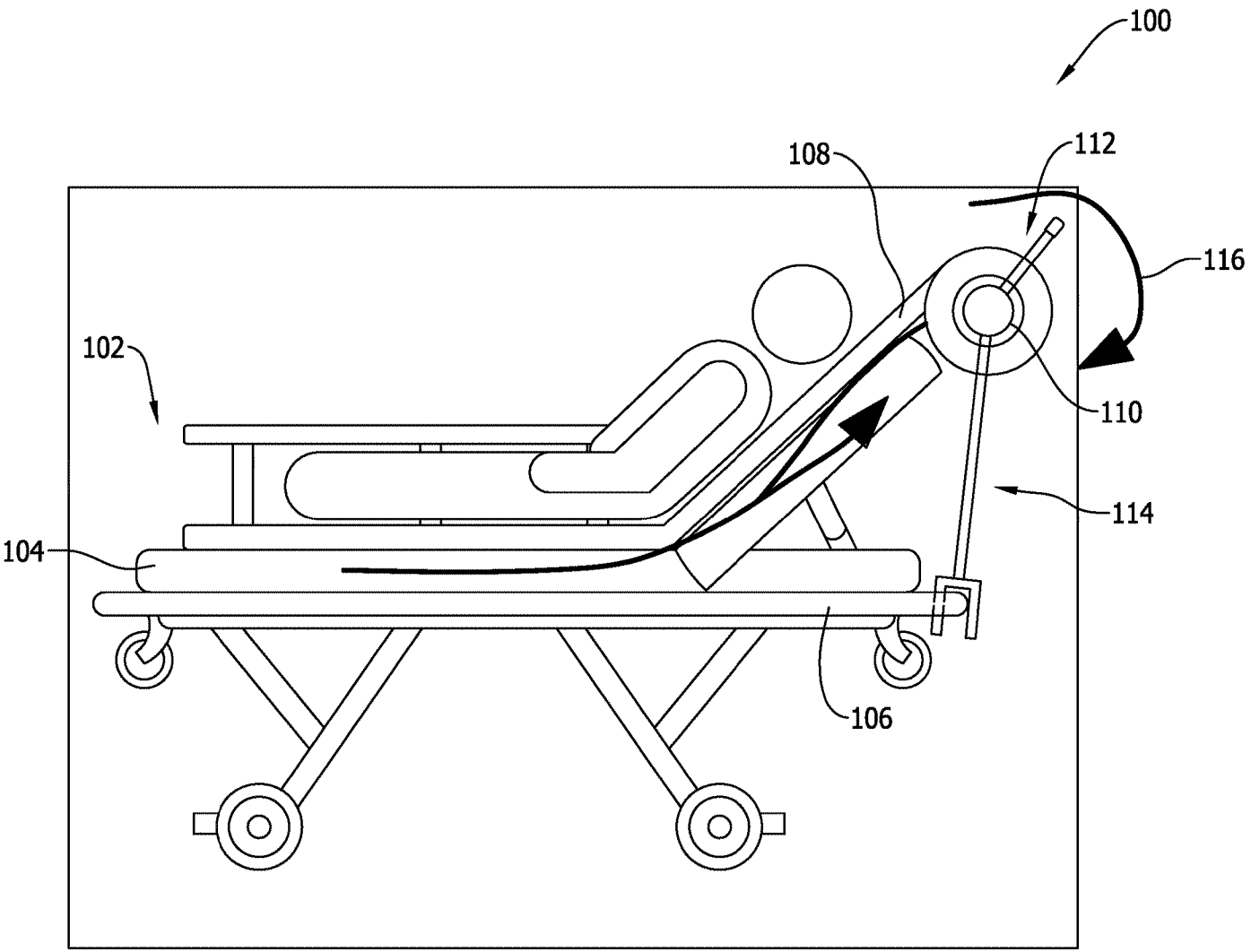
FIG. 1 is a schematic diagram of an exemplary patient positioning system.

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural, logical, software, electrical and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

A description of an embodiment with several components in communication with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of embodiments of the present invention in which, for example, functions may be executed out of order from that shown or discussed, including substantially concurrently or in reverse order, depending on the functionality involved, as would be understood by those having ordinary skill in the art.

Figure 2:
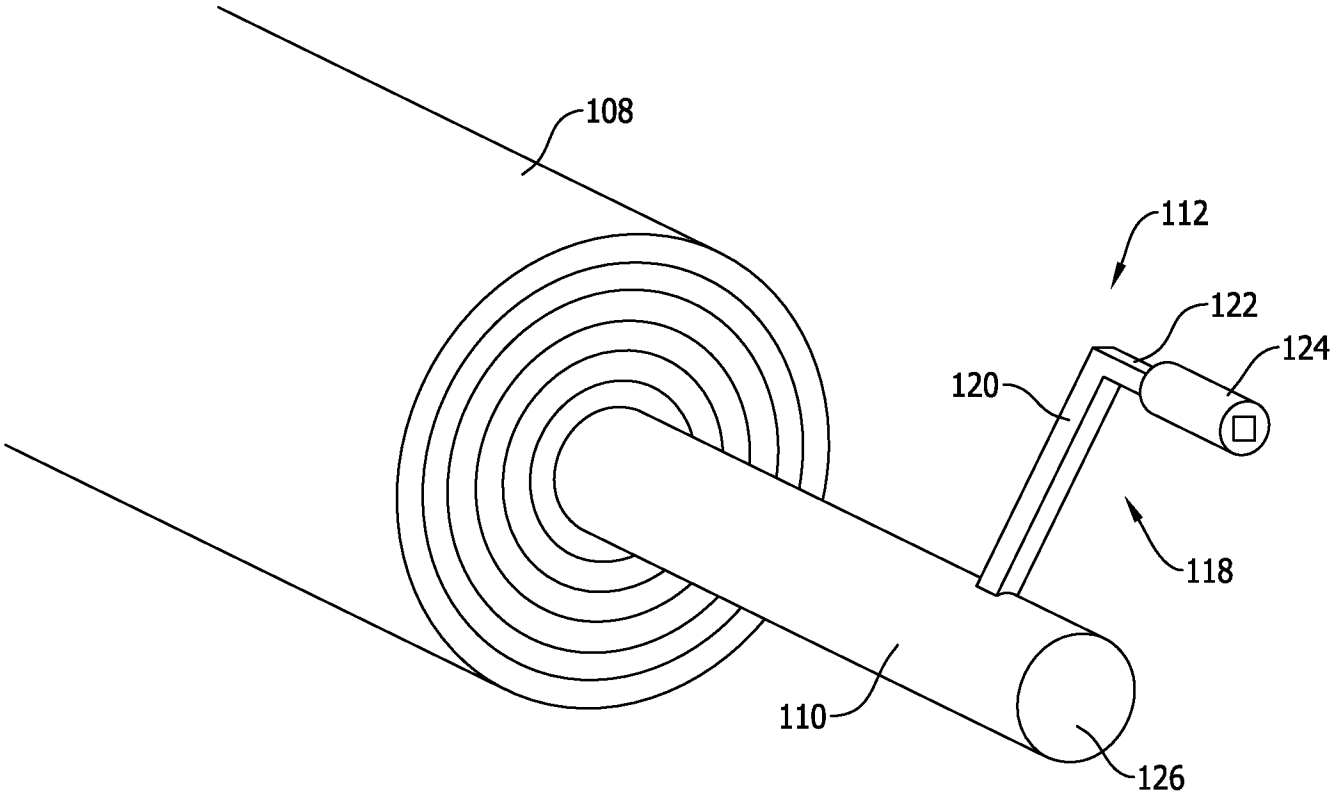
FIG. 2 is a perspective view of a portion of the patient positioning system shown in FIG. 1.
Figure 3:
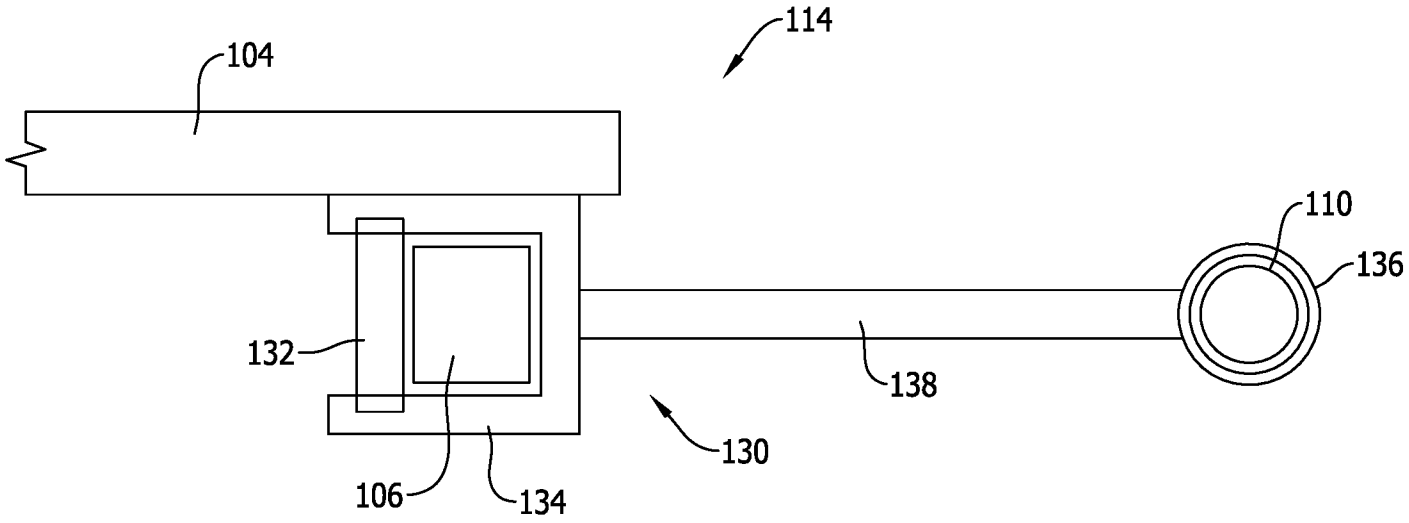
FIG. 3 is a side view of another portion of the patient positioning system shown in FIG. 1.

FIG. 1 is a schematic diagram of an exemplary patient positioning system 100. FIG. 2 is a perspective view of a portion of the patient positioning system 100 shown in FIG. 1. FIG. 3 is a side view of another portion of the patient positioning system 100 shown in FIG. 1.

FIG. 1 illustrates a patient in an incline position on a bed 102 including a mattress 104 and a frame 106. A patient positioning system 100 is coupled to frame 106 and functions to assist in repositioning the patient on the mattress 104. System 100 includes an overlay 108 positioned over the mattress 104, a roller 110 coupled to frame 106, a crank assembly 112 configured to rotate roller 110, and a mounting assembly 114 to mount roller 110 and overlay 108 to frame 106.

In the exemplary embodiment, overlay 108 lies beneath the patient and is wound around roller 110. Overlay 108 is used to pull the patient toward the head of mattress 104 when the overlay 108 is wound around roller in the direction of arrow 116. When not in use, overlay 108 can be rolled onto roller 110 and secured using straps. Overlay 108 comprises any type of material that attaches to the roller 110 and interacts with the patient who is laying on the incline bed 102, the roller 110, and the health care provider when they pull the overlay 108 down so that it stretches across the entire mattress 104. When the patient positioning system 100 is being used, the overlay 108 lies across the entire mattress 104 under the patient. When the patient positioning system 100 is being stored, or not in use, the overlay 108 is rolled up onto the roller 110 and held in place with two Velcro straps. Overlay 108 is preferably shaped like a blanket, a rectangular cut of fabric that is longer than the mattress 104 itself but thinner than the width of the mattress 104. However, the shape of the fabric will not prevent the overlay 108 from operating. Overlay 108 is mainly thought to be composed of an antimicrobial fabric widely used in hospitals, but it may be any type of washable/sanitizable fabric. One goal of overlay 108 is to be the medium that moves up/holds the patient on the incline bed 102 by moving the patient up when the overlay 108 moves up as a result of the crank 112 turning the roller 110.

As illustrated, patient positioning system 100 is a manual system where a health care provider uses crank assembly 112 to rotate roller 110, which rolls overlay 108 and pulls the patient upward. The crank assembly 112 includes an L-rod 118 that includes a first portion 120 inserted into a cutout in the roller 110 and a second portion 122 that is coupled to an end of the first portion 120 and extends away from overlay 108. The length of portions 120 and 122 is determined based on the force necessary to move the patient. More specifically, the L-rod length has been optimized for a 5th percentile individual to be able to move the crank 112 easily. L-rod 118 interacts with roller 110 and the health care provider to rotate the overlay 108. L-rod 118 is inserted into a rectangular cut out in the roller 112, which secures the L-rod 118 and allows it to turn the roller 110 and overlay 108. The function of L-rod 118 is to help the health care provider rotate the roller 110, which winds the overlay 108 up onto the roller 110 and moves the patient along with it. Crank 112 is the mechanism by which the overlay 108 is rotated and moved. If crank assembly 112 is rotated the other way, a clutch is enacted and initiates a clicking sound which lets the health care provider know they are moving the crank assembly 112 in the wrong direction.

A handle 124 is coupled around second portion 122 to aid in the comfort of the health care provider when rotating crank assembly 112. Handle 124 comprises the part of the crank 112 by which the health care provider controls, moves, or manipulates the crank 112. Handle 124 interacts with the metal L-rod 118 and also with the health care provider. Handle 124 is attached to the metal l-rod and is a part of the crank. Spatially, handle 124 is preferably positioned on the exposed end of second portion 122 that points away from the incline bed 102 and overlay 108. Handle 124, in one embodiment, is composed of a glow in the dark rubber which makes the handle 124 easy to touch and use. The glow in the dark function provides an important functional benefit by allowing the health care provider to easily identify and grab the handle 124 in darkness, when light may awaken or interrupt a patient's sleep. However, it is thought that in alternate embodiments that the thing may also be composed of plastic, rubber, wood, stainless steel, and metal. One goal of handle 124 is to provide the health care provider with a way to control the overlay 108 in a user-friendly way.

Additionally, roller 112 includes an end cap 126 coupled at each end of roller 110 to cover the ends and protect the patient or health care provider from injury. End cap 126 comprises a material cap or cover for the edges of the roller 110, with one end cap used on each end. End cap 126 interacts with the edges of the roller 110 so that none of the edge is exposed. End cap 126 is mainly thought to be composed of plastic however; it is thought that in alternate embodiments that end cap 126 may also be composed of plastic or metal.

As shown in FIG. 3, overlay 108 and roller 110 are coupled to frame 106 using a mounting system 114. Mounting system includes a pair of clamps 130 and a plurality of straps 132 that couple clamps 130 to frame 106. Each clamp 130 includes a U-shaped portion 134, a ring portion 136, and an optional rod 138 that couples ring portion 136 to U portion 134. In the exemplary embodiment, U portion 134 is meant to fit around frame 106 and 0 portion 136 fits around roller 110 to enable roller 110 to rotate. U-portion 134 is positioned beneath mattress 104 and is coupled to frame 106 via straps 132.

Clamps 130 attach to the bed frame 106 in order for the overlay 106 to work best with incline beds 102 that can adjust the incline and move it up and down, such as hospital beds. Clamps 130 also hold the roller 110 to prevent risk to the patient on the incline bed, so the roller 110 does not fall or get knocked off and potentially injure the patient. Clamps 130 interact with the health care provider who does the initial overlay setup, the roller 110 because it is helping the clamps 130, the straps 132, which go through the clamps 130 and strap around the bed frame 106, and the bed frame 106 itself as the clamps 130 are attached onto the bed frame 106 beneath the mattress 104. Clamps 130 surround the bed frame 106 and are supported/attached tightly with two straps fabric 132 that wrap around part of the bed frame 106. This keeps the clamps 130 sturdily attached to the frame 116, which therefore keeps the drum in place and makes it safe for the patient. Spatially, clamps 130 are preferably positioned on the bed frame 106 at the head of the bed, underneath the mattress 104. The bed frame 106 is a thin rectangular bar, and the inside of U portion 134 of the clamps 130 fit perfectly over the bar 116. The "0" portion 136 is on the bottom of the U portion 134 of the clamp 130. Clamps 130 are preferably shaped like a 'u' with an 'o' on the bottom of the U portion 134, and two slits for straps 132 to go through at the top two lines of U portion 134. However, it is thought that in alternative embodiments that it may also be shaped like a rectangular box with a box cut out at the bottom, forming a boxy 'A' shape, and a circle in the top of the box for the drum to go through.

In some embodiments, it is thought that examples of clamps 130 may include: Velcro straps that wrap around the roller 110 and hold it to the bed frame 106, or metal rings with extending bars that attach to the bed frame 106. The two sides would attach to the bed frame 106 and one would be movable so the roller 110 could be coupled between the bars. If clamps 130 were replaced, the invention would continue to work, however, without the clamps 130 and without replacement, the roller 110 would rest on the ground, and make the invention very ineffective and potentially even impossible to operate. One goal of clamps 130 is to hold the roller 110 component of the overlay 106, and attach it sturdily to the bed frame 106. This ensures the safety of the patient using the overlay 108 and preserves functionality.

Straps 132 comprise long thin pieces of fabric that help keep an object in place, in this case, keeping clamps 130 strapped and attached to the bed frame 106, by feeding the fabric through a buckle that connects both ends of the straps 132 into a loop with adjustable levels for maximum tightness/security. Straps 132 interact with the bed frame 106, and the clamps 130. The straps 132 wrap around part of the bedframe 106, and they are fed through the clamps 130 to hold them attached to the bed frame in a sturdy fashion. Spatially, straps 132 are preferably positioned by being fed through the slits in the clamps 130, and then across the top and bottom of the bed frame 106, and then meet near the middle of the bed frame 106. In some embodiments, it is thought that an example of straps 132 could be Velcro loops or perhaps ropes and the like. One goal of straps 132 is to hold the clamps 130 and overlay 106 in place by keeping the clamps 130 sturdy, which in turn keeps the entire patient positioning system 100 sturdy. They help provide and ensure a safe user experience as well as maintaining structural stability.

Figure 4:
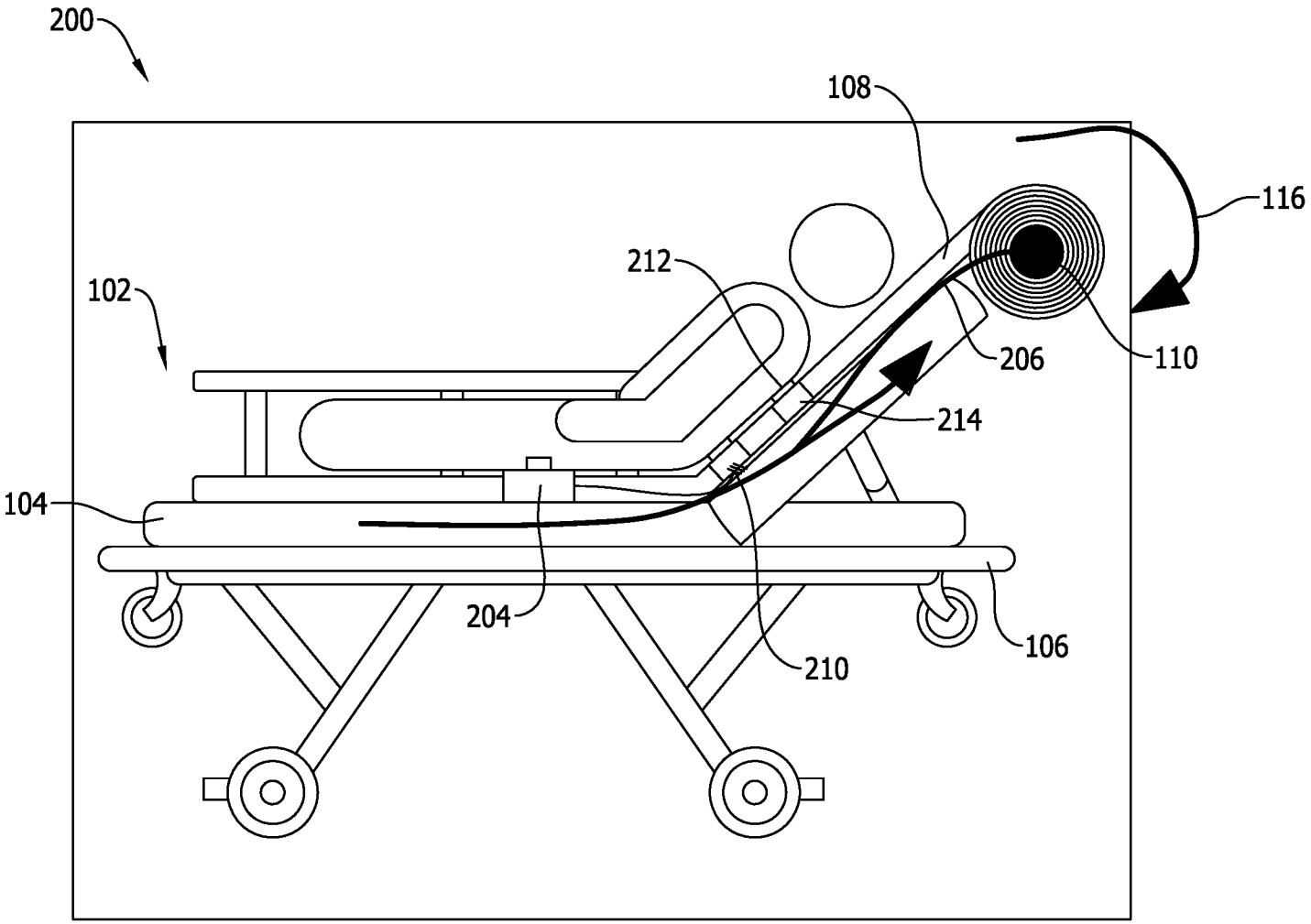
FIG. 4 is a schematic diagram of another patient positioning system.
Figure 5:
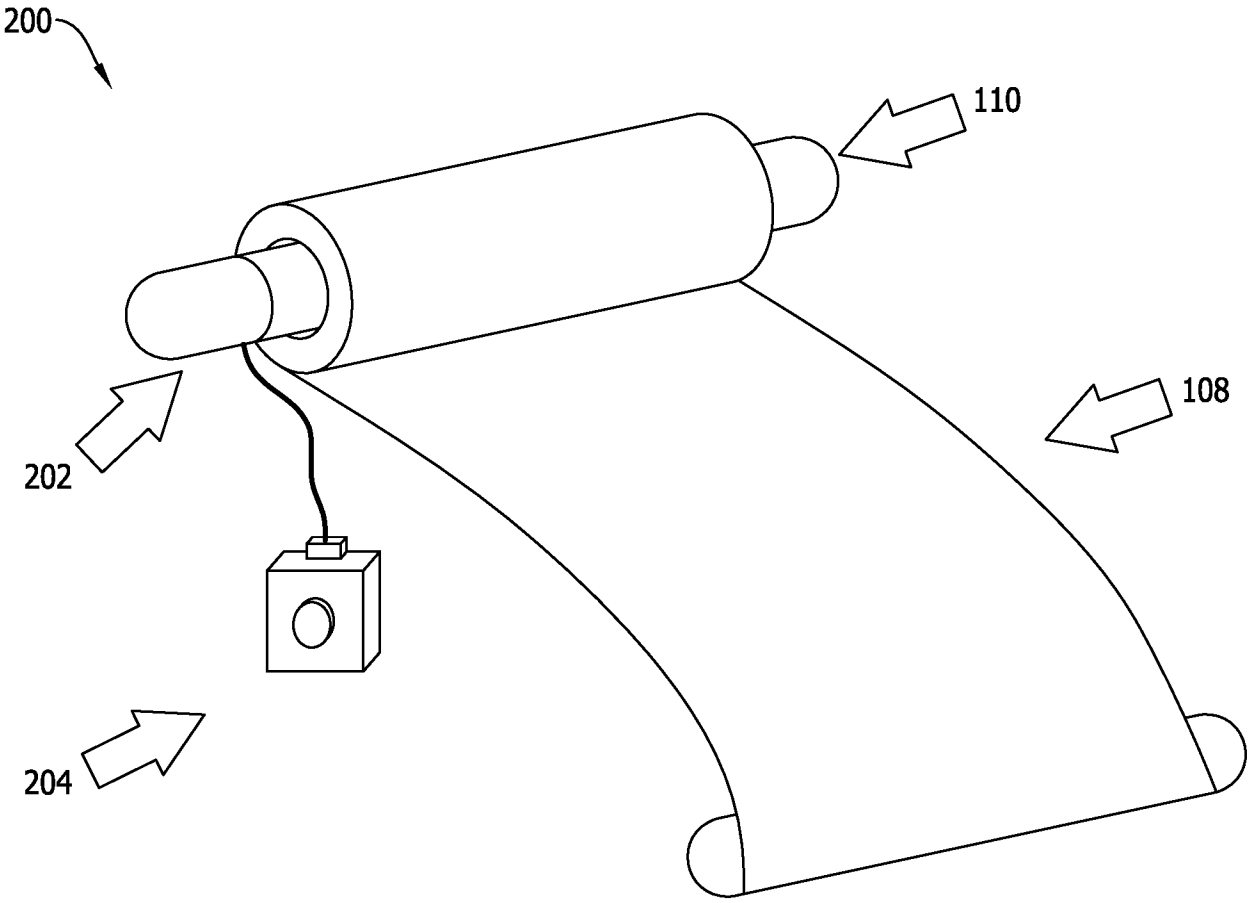
FIG. 5 is a perspective view of the patient positioning system shown in FIG. 4.

FIG. 4 is a schematic diagram of another patient positioning system 200. FIG. 5 is a perspective view of the patient positioning system 200 shown in FIG. 4. Patient positioning system 200 is similar to patient positioning system 100 except that patient positioning system 200 includes a motor 202 to rotate roller 110 rather than the manual crank assembly 112 (shown in FIG. 2). In the illustrated embodiment, motor 202 is operated by a switch or button 204 that is operable by the patient or the health care provider.

Motor 202 comprises a machine that is powered by electricity and supplies motive power that rotates roller 110 of patient positioning system 200 to pull overlay 108 and roll overlay 108 around roller 110. Motor 202 interacts with the switch 204 and the roller 110 and is coupled to an end of the roller 110. A wire 206 extends from motor 202 to switch 204. When the switch 204 is activated, a signal travels up the wire 206 and signals the roller 110 to rotate. One goal of motor 202 is to motorize the motion of the roller 110 and move it without the need for a crank. This motorization will spin the roller 110, and allow the overlay 108 to wind up around it, allowing the process of holding/repositioning a patient on the mattress 104 to be fulfilled.

Switch 204 comprises an electric switch which is operated by moving a lever up or down, and in this case it is used to engage the motor 202 and cause motor 202 to begin rotating the roller 110. Switch 204 is operable to engage motor 202 to operate motor 202 in both directions. That is, switch 204 is operable to engage motor 202 to rotate motor 202 in two opposite directions to selectively pull overlay 108 upward to reposition the patient and also to unroll overlay 108 when the patient is not on the mattress 104 to prepare for the patient.

Switch 204 also includes an LED light so a caregiver/patient can find the switch 204 even in the dark. Switch 204 interacts with the caregiver/patient and the motor 202. Switch 204 is preferably positioned near the patient or caregiver/user, to allow for easy access to anyone who wishes to operate the system/engage the motor 204. The switch 204 connects to the motor 202 with a wire 206, so it will always be a set distance away from the motor 204.

Switch 204 is preferably shaped like a rectangular box which has the toggle switch centered in the middle. However, it is thought that in alternative embodiments that it may also be shaped like a circle, a triangle, a square, or an oval. Switch 204 is mainly thought to be composed of plastic. However other embodiments may be composed of any combination of the following: plastic, metal, rubber, or wood. In some embodiments, it is thought that examples of switch 204 may include: a push switch, a remote control, an on and off switch, or a sensor operated switch, like a remote, which doesn't require a wire to connect it to the motor 202. One goal of switch 204 is to allow the caregiver/patient/user to engage the motor 202 or turn it off at will and with ease, by moving a switch or pushing a button that causes the motor 202 to start or stop rotating the roller 110.

Patient positioning system 200 also includes a sensor system 210 that includes a plurality of pressure sensors 212 coupled to straps 214 that wrap around mattress 104 and are positioned between mattress 104 and overlay 108. Preferably, pressure sensors 212 are positioned on top of the Velcro straps 214, on the side of the mattress 104 that faces the ceiling. The pressure sensors 212 are positioned across the length of the Velcro strap 214 across the mattress 104, and the distance between the Velcro straps 214 is a set distance determined by the height of a patient on an incline bed 102. Pressure sensors 212 comprise an electrical unit that registers when pressure is applied to it. When the applied pressure is removed, the sensors alert the motor 202, which is activated to rotate the roller 110 and return a patient back to their proper position on the incline bed 102. Pressure sensors 212 interact with Velcro straps 214, with the patient, and with the motor 202. One goal of pressure sensors 212 is to register when a patient is in the proper position in an incline bed, by reacting when the pressure that is normally exerted on the pressure sensors 212 is removed because a patient has slid down in an incline bed 102. The sensor 212 then alerts the motor 202 and activates it to rotate the roller 110, which winds up the overlay 108 and holds/repositions a patient on the mattress 104.

Figure 6:
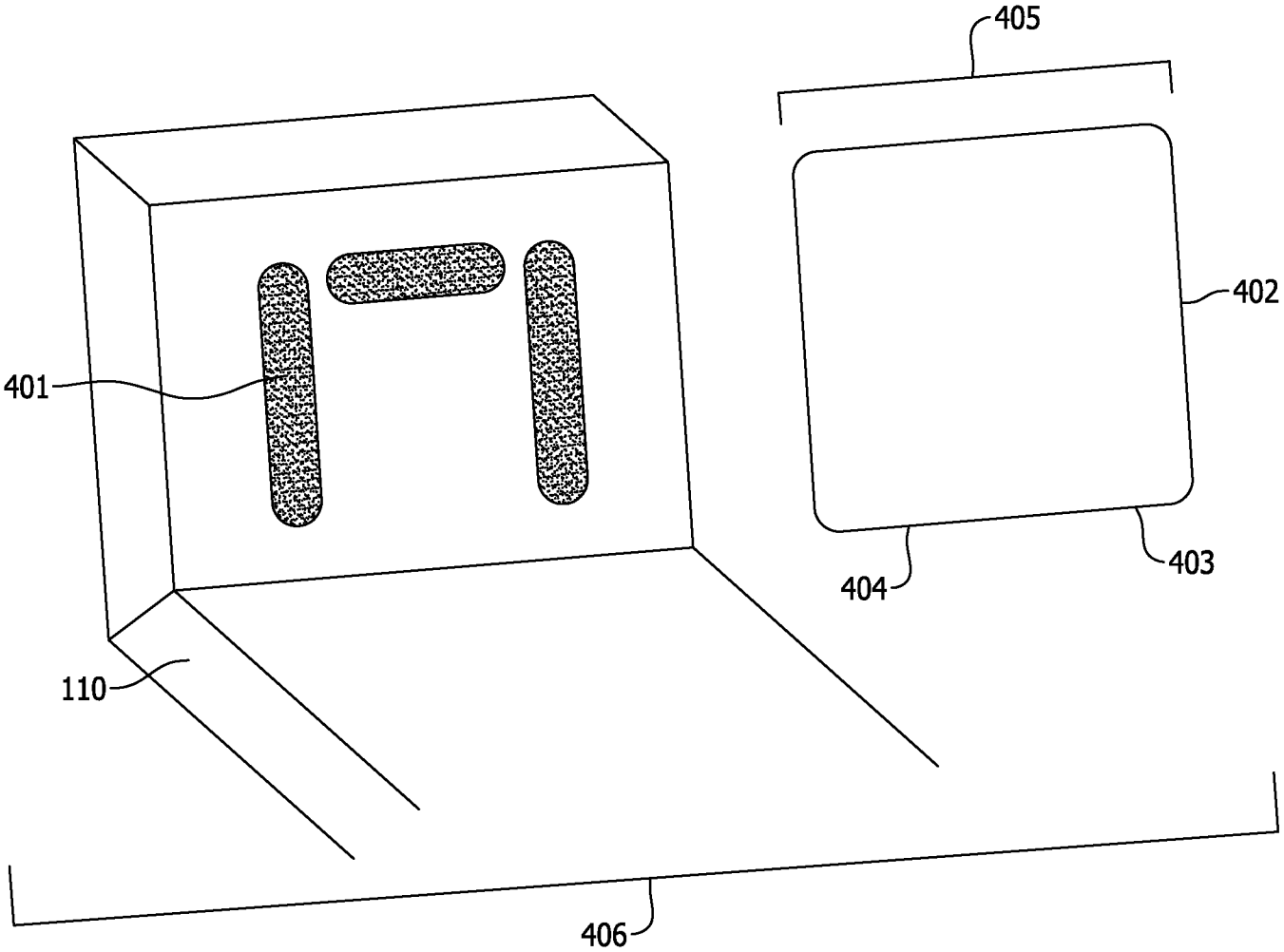
FIG. 6 is a perspective view, which shows a perspective view of a Velcro attachment and its related components.

FIG. 6 is a perspective view, which shows a perspective view of a Velcro attachment 400 and its related components. Velcro hooks 401 comprise one side of Velcro, which is the rougher part. The small plastic bits are shaped like hooks, which attach to the other side of the Velcro—the loops. Velcro hooks 401 interact with multiple items: First, Velcro hooks 401 interact with the mattress cover. Next, it interacts with the user during initial installation. Finally, it interacts with the loop. Velcro hooks 401 is attached to the hook also attaches to the loop, when the patient puts on the article of clothing which has the loop on it, and lies on the bed and the mattress cover. While the mattress cover is not part of the invention itself, the hook needs to attach to it so the loops of the second half of Velcro can attach to it and be held in a fixed spot. Spatially, Velcro hooks 401 is preferably positioned on the inclined half of the incline bed, and it is positioned so that the patient who 'attaches' to it connects to the Velcro and is still positioned with their hips at the angle in the bed where the flat portion and incline portion meet.

Velcro hooks 401 is preferably shaped like two horizontal strips whose width is proportional to the weight of the patient, with the width increasing if the weight of the patient is greater, however, it is thought that in alternative embodiments that it may also be shaped like a u shape on the inclined half of the incline bed, vertical strips, or a square box on the inclined half of the incline bed. In some embodiments, it is thought that if Velcro hooks 401 is absent then the loop and holding material has nothing to attach to on the hospital bed, and therefore, the patient cannot be held in an upright position in an incline bed. One goal of Velcro hooks 401 is to provide something for the loops and fabric that the patient is wearing to connect to, so they can remain in place on the incline bed. Velcro loops 402 comprise the other half of Velcro, the softer half, which has small loops of fabric that the hook can connect to. Velcro loops 402 interact with multiple items: First, Velcro loops 402 interact with the hook. Next, it interacts with the patient. Finally, it interacts with the holding material. Velcro loops 402 is attached to the hook and the holding material, which is then ironed on to whatever clothing for the upper body the patient is wearing (ex. t-shirts, long sleeve shirt, hospital gown). Spatially, Velcro loops 402 are preferably positioned on the holding material that can be ironed on to a t-shirt or other article of clothing that a patient wears. The proper placement is on the clothing that would rest on the back of the patient.

Velcro loops 402 is preferably shaped like two horizontal strips whose width is proportional to the weight of the patient, with the width increasing if the weight of the patient is greater, however, it is thought that in alternative embodiments that it may also be shaped like a u shape on the inclined half of the incline bed, vertical strips, or a square box on the inclined half of the bed. In some embodiments, it is thought that if Velcro loops 402 are absent then the fabric the patient is wearing has nothing to connect to on the incline bed itself, so the invention cannot work because the person will not be in a fixed position on the incline bed. One goal of Velcro loops 402 is to be the part of the invention that connects to the hook and holds the patient in place.

Holding material 403 comprises a piece of fabric that the strips of the loop are attached to. It is the material that has the adhesive on the back of it, and can be ironed on to any piece of clothing a patient would wear, including but not limited to t-shirts, any shirts, or hospital gowns. Holding material 403 interacts with multiple items: First, holding material 403 interacts with the patients clothing. Next, it interacts with the loop. Finally, it interacts with adhesive backing. Holding material 403 is attached to the patients clothing. While the patients clothing is not part of this invention, it is needed because it provides the base for the holding material to attach to, and allows the patient to be held on an incline bed. Spatially, holding material 403 is preferably positioned on the back of the patient's clothing, and it is attached to an article of clothing that covers the upper body. It is placed on the back of this, so that it rests on the patients back, and faces towards the incline bed. Holding material 403 is mainly thought to be composed of cotton, because it is the most versatile and can be ironed on, however other embodiments may be composed of any of the following: denim, work out material, like sweatpants, or any material that is relatively heat resistant. In some embodiments, it is thought that if holding material 403 is absent then there is not a material to assist the connection of the loops to the patients clothing. However, the invention can still work if the loops half of Velcro is attached directly to the users clothing. One goal of holding material 403 is to be the medium that allows the loops to be held on the patient's article of clothing.

Adhesive backing 404 comprises a filmy backing on the holding material which heats up when ironed, and allows the holding material to get 'stuck' to the article of clothing that it is being ironed onto. Adhesive backing 404 interacts with a couple of things: It interacts with the holding material and it also interacts with the patient's article of clothing. Adhesive backing 404 is attached to the holding material and the patient's article of clothing. Spatially, adhesive backing 404 is preferably positioned across the entire back of the holding material, eg. on the side that does not have the Velcro loops on it. In some embodiments, it is thought that if adhesive backing 404 is absent then the holding material has nothing to make it still to a patient's article of clothing when ironed. However, this can be bypassed as the holding material can be sewn on to the patient's article of clothing if necessary. One goal of adhesive backing 404 is to help the holding material quickly and easily connect to the patient's article of clothing.

Iron-on applique 405 comprises the Velcro loops, holding material, and adhesive backing. The iron-on applique is the attachment for the invention that the user can attach onto their article of clothing to hold them in place on their incline bed. Iron-on applique 405 interacts with a couple of things: It interacts with the hook and it also interacts with the patient's article of clothing. Iron-on applique 405 is attached to the patient's article of clothing and the hook Velcro. Spatially, iron-on applique 405 is preferably positioned by being attached to the back of the person's article of clothing, with the adhesive connecting to the article of clothing, and the Velcro loops facing towards the hospital bed. The rectangle iron-on applique's ideal position is in the upper center of the patient's back. Iron-on applique 405 is preferably shaped like a rectangular box that fits onto the back of a person's t-shirt; however, it is thought that in alternative embodiments that it may also be shaped like a circle, a u shape, or square.

Iron-on applique 405 is mainly thought to be composed of cotton, however other embodiments may be composed of any of the following: denim, work out clothing (like sweatpants material), or any heat resistant material. In some embodiments, it is thought that an example of iron-on applique 405 may include a sewn patch that interacts with pulley overlay material 108 and the like. In some embodiments, it is thought that if iron-on applique 405 is absent then there is nothing that helps hold the patient in a safe position on an incline bed, and so the invention does not work. One goal of iron-on applique 405 is to be the mechanism that attaches to the patient's article of clothing and helps keep the patient held in a proper position in their hospital bed. Iron-on applique 405 preferably comprises Velcro loops 402, holding material 403, and finally adhesive backing 404. Velcro attachment 406 comprises Velcro hooks 401 and iron-on applique 405.

Figure 7:
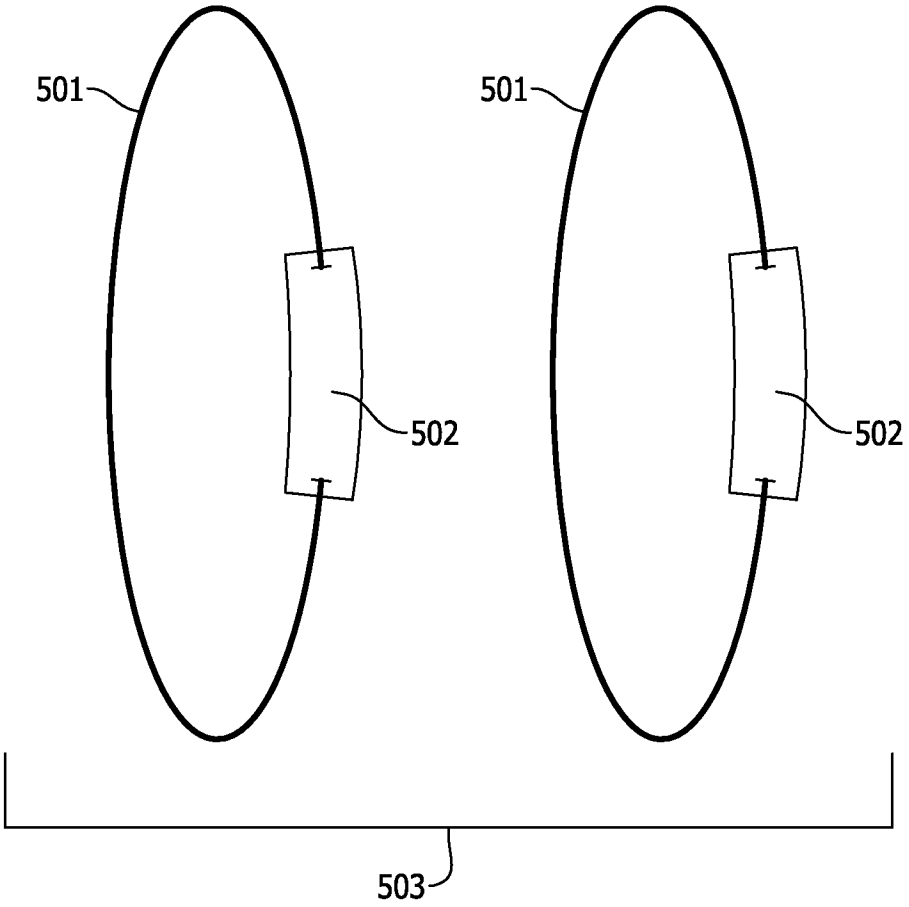
FIG. 7 is a perspective view, which shows a perspective view of a harness system and its related components.

FIG. 7 is a perspective view, which shows a perspective view of a harness system 500 and its related components. Bungee cords 501 comprises a stretchy rope or cord that are in loops and go under a patients armpits and hook onto the bed frame to keep them held up on an incline bed. Bungee cords 501 interact with multiple items: First, bungee cords 501 interact with the patient. Next, it interacts with fabric pads. Finally, it interacts with the mattress/incline bed. Bungee cords 501 are attached to fabric pads and the edges of the bed frame or mattress. Spatially, bungee cords 501 is preferably positioned underneath the armpits of the patient, and the loops hangs and attaches on the edges of the mattress of the incline bed to hold the patient in place. It also has fabric pads that go around it, and they can and should be adjusted to go underneath the armpits of the patient to prevent injury.

In some embodiments, it is thought that an example of bungee cords 501 could be ropes or perhaps fabric loops and the like. In some embodiments, it is thought that if bungee cords 501 are absent then there is no system or material that holds the patient in place on an incline bed and this embodiment or version of the invention does not work. One goal of bungee cords 501 is to hold the patient in place on an incline bed by helping them remain in an unchanging position.

Fabric pads 502 comprises two rectangular sheets of material that are sewn together with two identical gaps left in the center of both short sides of the rectangle, so the bungee cords can go through it. Fabric pads 502 interact with a couple of things: It interacts with the bungee cords and it also interacts with the patient. Fabric pads 502 are attached to the bungee cords. Spatially, fabric pads 502 are preferably positioned underneath the armpits of the patient, where the bungee cord goes underneath. The fabric pads are in place to prevent the bungee cords from rubbing against the patient's skin. In some embodiments, it is thought that an example of fabric pads 502 may include miniature pillows and the like. In some embodiments, it is thought that if fabric pads 502 are absent then the invention will still function however the patient will be significantly less comfortable because there is no fabric underneath their arms to protect from the bungee cord rubbing against them. One goal of fabric pads 502 is to prevent the bungee cords from rubbing against the skin of the patient and potentially causing injury, by sheltering the patient from the bare bungee cords. Harness system 503 comprises bungee cords 501 and fabric pads 502.

Figure 8:
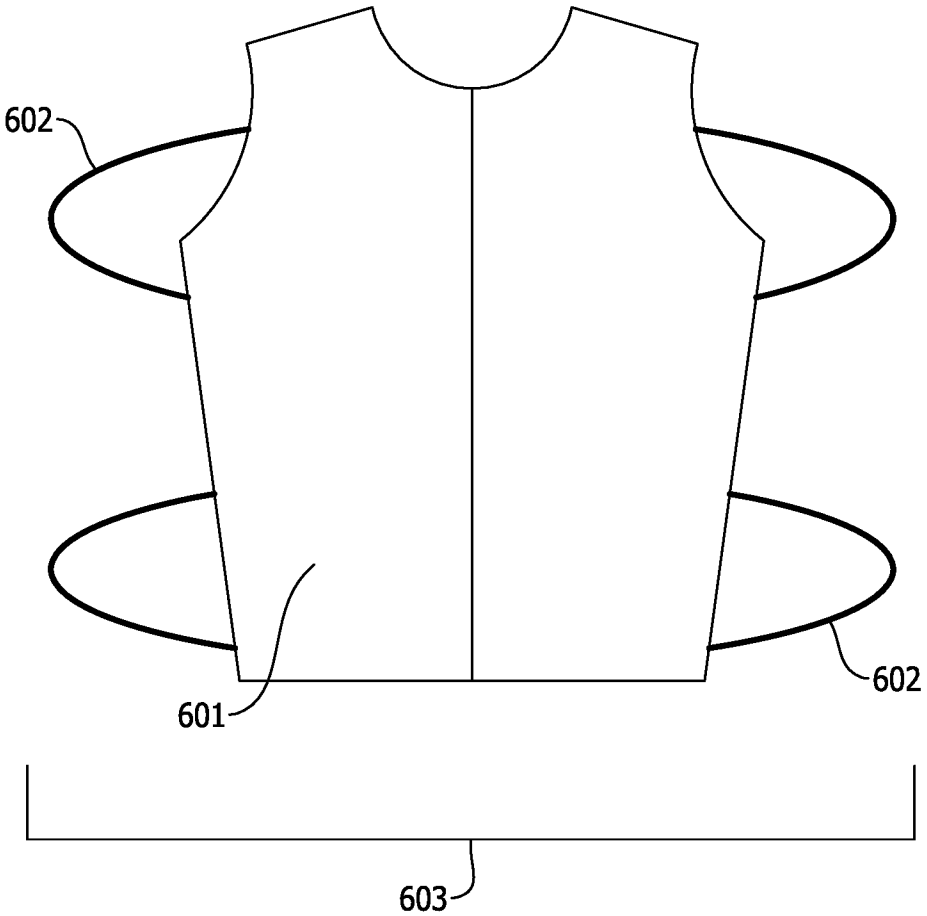
FIG. 8 is a perspective view, which shows a perspective view of a vest model and its related components.

FIG. 8 is a perspective view, which shows a perspective view of a vest model 600 and its related components. Fabric vest 601 comprises a piece of clothing that is worn on the upper half of the body. It's like a jacket with the sleeves removed, and it can be removed or put on by form of zipper, Velcro, or buttons. Fabric vest 601 interacts with multiple items: First, fabric vest 601 interacts with the Velcro straps. Next, it interacts with the patient. Next, it interacts with the caregiver when putting the vest on the patient. Finally, it interacts with the incline bed. Fabric vest 601 is attached to Velcro straps, which attach to the bed. Spatially, fabric vest 601 is preferably positioned on the body of the patient on the incline bed, with the vest covering their torso and upper body and their arms going through the two holes on the side of the vest. The vest is meant to be held with Velcro on the upper half of the bed, where the incline is, and be held there by the Velcro straps.

Fabric vest 601 is mainly thought to be composed of cotton; however other embodiments may be composed of any of the following: linen, wool, cotton, or polyester-cotton blend. In some embodiments, it is thought that examples of fabric vest 601 may include: a t-shirt made of sturdy fabric, a jacket, or any shirt that is made of sturdy (i.e. non-stretch) material. In some embodiments, it is thought that if fabric vest 601 is absent then there is nothing for the Velcro to attach to, or for the patient to wear, so the vest system cannot hold the patient on an incline bed in the proper position. One goal of fabric vest 601 is to provide the patient with something that goes around their body to help prevent their body from sliding down, without causing additional difficulty to them.

Bed straps 602 comprise two loops of Velcro fabric that connect with each other in the back, and wrap around the width of the hospital bed. Around bed straps 602 interacts with multiple items: First, around bed straps 602 interacts with the vest. Next, it interacts with the mattress/incline bed. Next, it interacts with the caregiver/user during initial setup. Finally, it interacts with the patient. Around bed straps 602 is attached to the vest and the bed. Spatially, around bed straps 602 is preferably positioned at the top half of the incline bed, where the incline exists. The straps are positioned so that when the patient lies on the incline bed their upper half is on the incline, with their bottom and hips at the point where the angle of the bed changes. Bed straps 602 are mainly thought to be composed of Velcro. In some embodiments, it is thought that if around bed straps 602 is absent then there is nothing for the vest to attach to and hold it in place, and as a result the patient is simply wearing a vest, but the invention no longer works, because the patient is not being held in the same position on an incline bed. One goal of bed straps 602 is to provide the means by which the vest, and in turn, patient, are held in place on an incline bed, because it attaches to the vest and bed, providing the vest with a specific point to remain at, and the patient remains there with it. Vest model 603 comprises fabric vest 601 and around bed straps 602.

Figure 9:
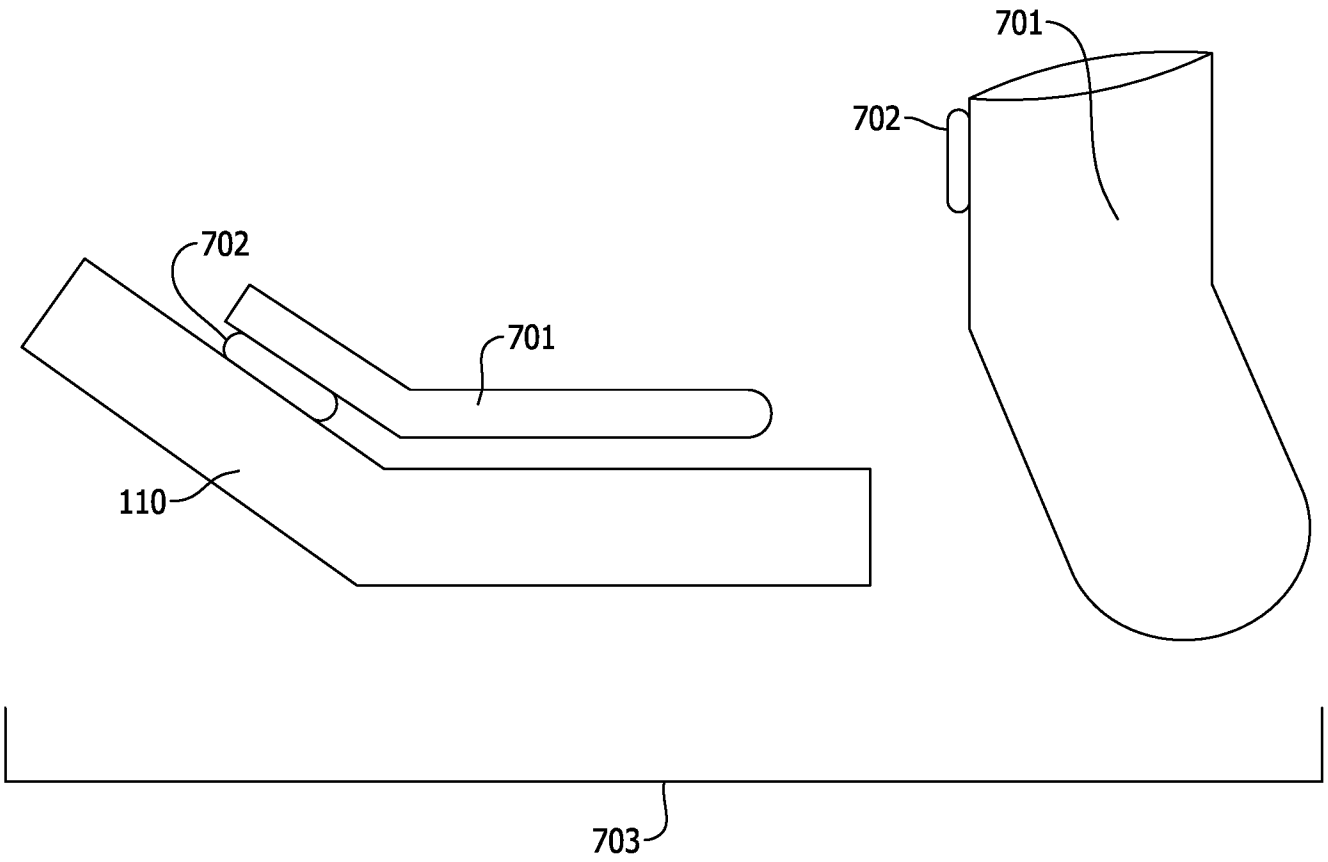
FIG. 9 is a perspective view, which shows a perspective view of a sleeping bag model and its related components.

FIG. 9 is a perspective view, which shows a perspective view of a sleeping bag model 700 and its related components. Fabric pocket 701 comprises two rectangular pieces of fabric sewn together across all sides except for the top longest piece of the rectangle. It is used to keep the patients feet from sliding down on the incline bed, in order to hold them in the same position. Fabric pocket 701 interacts with multiple items: First, fabric pocket 701 interacts with the mattress cover. Next, it interacts with the patient. Next, it interacts with the caregiver during initial setup. Finally, it interacts with the Velcro attachment.

Fabric pocket 701 is attached to the mattress cover, by means of sewing, Velcro, iron on application, etc. Spatially, fabric pocket 701 is preferably positioned on the bottom half of the incline bed. The specific point is determined by the height of the patient on the incline bed, with the fabric pocket attached to the mattress cover at the point where the patient's feet hit the bottom of it, while at the same time their hips and bottom are at the point of angle of the bed. Fabric pocket 701 is mainly thought to be composed of cotton; however other embodiments may be composed of any of the following: linen, polyester-cotton blend, cotton-nylon blend, or synthetic fabric.

In some embodiments, it is thought that if fabric pocket 701 is absent then there is nothing preventing a patient's feet and rest of body from sliding down on an incline bed, and into an uncomfortable or unsafe position. This particular version of the invention does not work if the fabric pocket is no longer there. One goal of fabric pocket 701 is to prevent the patient on an incline bed from sliding down the bed, and to hold them in the same position, by preventing their feet from moving beyond a certain distance.

Bed Velcro attachment 702 comprises two portions of Velcro, one which attaches to the mattress cover, and another which attaches to the fabric pocket. Bed Velcro attachment 702 interacts with a couple of things: It interacts with the fabric pocket and it also interacts with the mattress cover. Bed Velcro attachment 702 is attached to the fabric pocket and the mattress cover. Spatially, bed Velcro attachment 702 is preferably positioned the same way the fabric pocket is positioned. Based on the height of the patient, the Velcro straps are attached at the point where the patient's hips are at the angle of the inclined portion of the bed, and the rest of the bed and it is at the top of the fabric pocket.

In some embodiments, it is thought that an example of bed Velcro attachment 702 could be sewing thread or perhaps elastic band with fabric pocket sewn on and the like. In some embodiments, it is thought that if bed Velcro attachment 702 is absent then the fabric pocket will not be firmly attached to the bed, and will not be able to keep the patients feet from sliding past a certain point because the fabric pocket will simply slide down with the patient. The Velcro can be replaced if the fabric pocket is sewn on instead of attached with Velcro. One goal of bed Velcro attachment 702 is to keep the fabric pocket firmly in place by holding it in a predetermined position. Sleeping bag model 703 comprises fabric pocket 701 and bed Velcro attachment 702.

Figure 10:
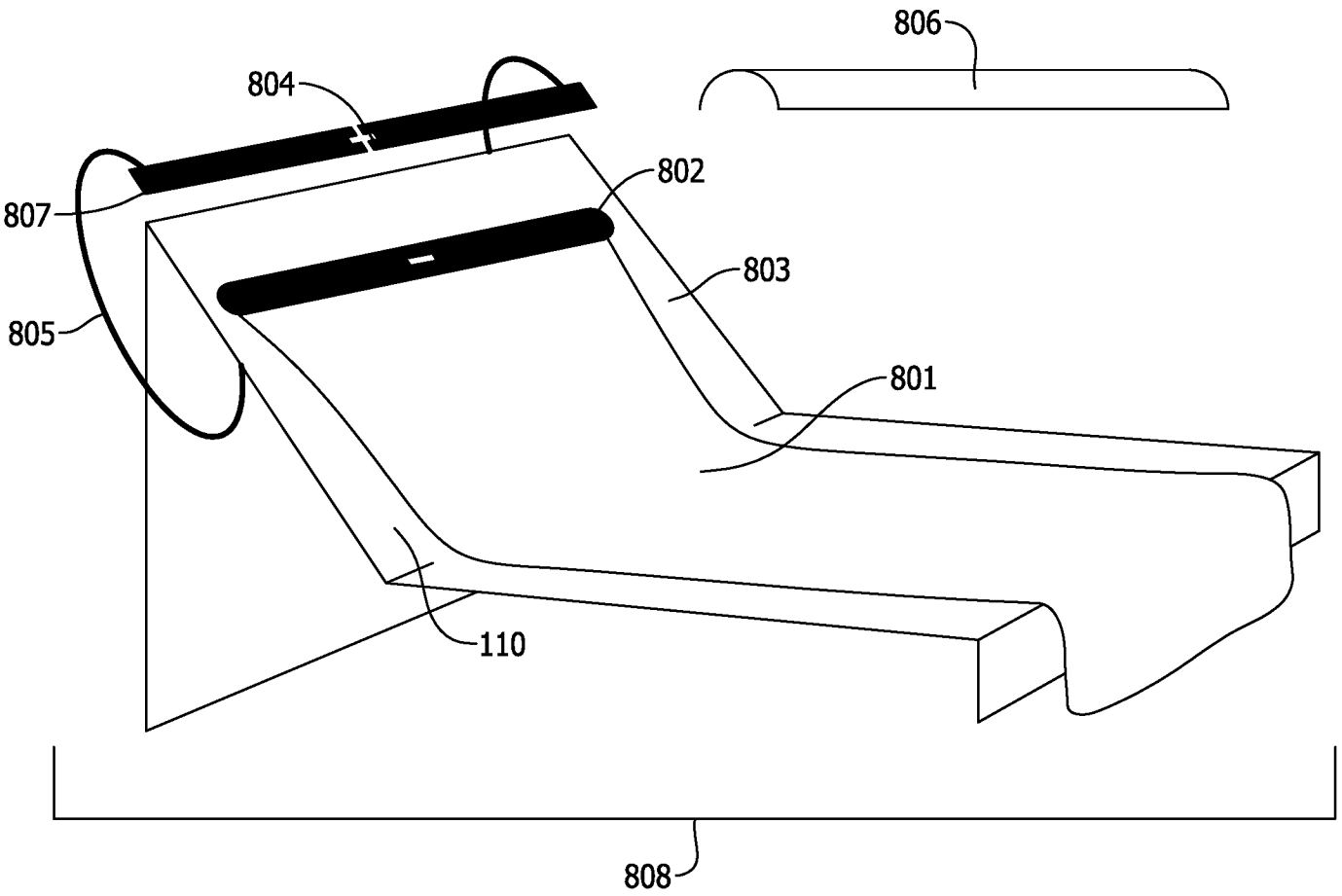
FIG. 10 is a perspective view, which shows a perspective view of a magnetism method and its related components.

FIG. 10 is a perspective view, which shows a perspective view of a magnetism system 800 and its related components. Underlay material 801 comprises fabric that lies on the bed underneath the patient, and it has a negatively charged magnet inside of it. Underlay material 801 interacts with multiple items: First, underlay material 801 interacts with the patient. Next, it interacts with the negatively charged magnet, which is within the underlay. Finally, it interacts with the positively charged magnet which attracts the underlay and negative magnet. Underlay material 801 is attached to the positively charged magnet when it gets pulled up with magnetism. Spatially, underlay material 801 is preferably positioned underneath the patient on the incline bed, with the negatively charged magnet at the top of the underlay and positioned towards the head of the bed.

Underlay material 801 is mainly thought to be composed of an antimicrobial washable material that is widely used in hospitals however; it is thought that in alternate embodiments that the thing may also be composed of any fabric that is washable and sanitizable. In some embodiments, it is thought that an example of underlay material 801 may include any fabric that is washable and sanitizable and the like. In some embodiments, it is thought that if underlay material 801 is absent then the invention no longer works, because there is no fabric in place to pull the patient upwards with a magnet when they slide down. One goal of underlay material 801 is to provide the mechanism by which the patient is pulled upwards on the incline bed into the proper position.

Magnet with negative pole 802 comprises a magnet that is negatively charged, which is attached to the top of the patient underlay and it is attracted by the positively charged magnet. Magnet with negative pole 802 interacts with a couple of things: It interacts with the positively charged magnet and it also interacts with the patient underlay. Magnet with negative pole 802 is attached to the overlay, a the top and at some points in time, the positively charged magnet, because the positive magnet attracts the negative one until the negative one has pulled the overlay up with it and attached itself to the positively charged magnet. Spatially, magnet with negative pole 802 is preferably positioned at the top of the patient underlay, stretching across the width of the overlay.

Magnet with negative pole 802 is preferably shaped like a thin bar that stretches along the top of the patient underlay however; it is thought that in alternative embodiments that it may also be shaped like broken up squares or chunks of magnet or alternately a u-shaped magnet that faced downward. In some embodiments, it is thought that if magnet with negative pole 802 is absent then the positively charged magnet will not attract anything, and the overlay will not move as a result. One goal of magnet with negative pole 802 is to be attracted to the positively charged magnet, and as a result of that attraction, to pull itself towards the positively charged magnet, pulling the patient underlay and patient along with it.

Patient underlay 803 comprises the combination of the negatively charged magnet and the underlay material, which lies underneath the patient. Patient underlay 803 interacts with multiple items: First, patient underlay 803 interacts with the patient. Next, it interacts with the incline bed. Finally, it interacts with the positively charged magnet. Patient underlay 803 is attached to the positively charged magnet, when the negatively charged magnet inside the patient underlay causes it to be pulled upwards. Spatially, patient underlay 803 is preferably positioned underneath the patient, with the negatively charged magnet portion of it facing towards the head of the bed.

In some embodiments, it is thought that an example of patient underlay 803 may include any washable or sanitizable fabric that has a magnet laid into it and the like. In some embodiments, it is thought that if patient underlay 803 is absent then the patient underlay is absent then there is no mechanism by which the patient is moved up or repositioned on the incline bed, so the invention no longer works. One goal of patient underlay 803 is to provide the mechanism by which the patient is pulled upwards/repositioned on an incline bed, by moving the patient along with it, when the negatively charged magnet's attraction to the positive one causes the overlay to move. Patient underlay 803 comprises magnet with negative pole 802 and underlay material 801.

Magnet with positive pole 804 comprises a magnet with a positive charge which is placed at the head of the bed. Magnet with positive pole 804 interacts with multiple items: First, magnet with positive pole 804 interacts with the bedframe. Next, it interacts with the straps. Next, it interacts with the magnet with a negative charge. Finally, it interacts with the patient underlay. Magnet with positive pole 804 is attached to the bed frame and the straps. Spatially, magnet with positive pole 804 is preferably positioned at the head of the bed frame, with straps holding it in place. In some embodiments, it is thought that if magnet with positive pole 804 is absent then it is fulfilling part of the purpose of the overlay. Once the positively charged magnet pulls up the negatively charged one, it needs to be removed until it is time for the magnet with the overlay to be pulled up again. However, if the magnet was never there in the first place, then the overlay will not function because nothing will be in place to attract the negatively charged magnet and pull the overlay up the bed. One goal of magnet with positive pole 804 is to attract the negatively charged magnet with is connected to the patient underlay, and it as a result of the attraction, the negatively charged magnet will be pulled towards this one, and pull the patient upwards with it.

Positive magnet holding straps 805 comprises long thin pieces of fabric that help keep an object in place, in this case, keeping the positively charged magnet strapped and attached to the bed frame, by feeding the fabric through a buckle that connects both ends of the straps into a loop with adjustable levels for maximum tightness/security. Positive magnet holding straps 805 interacts with a couple of things: It interacts with the bed frame and it also interacts with the magnet. Positive magnet holding straps 805 is attached to the bed frame. Spatially, positive magnet holding straps 805 is preferably positioned at the top of the bed frame, wrapped around the magnet and across the bed frame so that the straps are taut and hold the magnet in its place. Positive magnet holding straps 805 is mainly thought to be composed of fabric straps that buckle. In some embodiments, it is thought that an example of positive magnet holding straps 805 could be fabric straps or perhaps Velcro straps and the like. In some embodiments, it is thought that if positive magnet holding straps 805 is absent then the magnet will not be held to the bedframe, and so the invention will not work because the positively charged magnet will not be in place to attract the negatively charged magnet. One goal of positive magnet holding straps 805 is to hold the positively charged magnet in place, so that it can effectively attract the negatively charged magnet and pull the overlay upwards.

Bed frame attachment 807 comprises the positively charged magnet connected to the bed frame with straps. Bed frame attachment 807 interacts with multiple items: First, bed frame attachment 807 interacts with the bed frame. Next, it interacts with the negatively charged magnet. Next, it interacts with the positively charged magnet. Finally, it interacts with the straps. Bed frame attachment 807 is attached to the bed frame. Spatially, bed frame attachment 807 is preferably positioned at the top of the bed, connected to the bed frame, with the straps of the attachment holding the positively charged magnet in place. In some embodiments, it is thought that if bed frame attachment 807 is absent then the magnet will not be held in place or existent and so the overlay will not be pulled upward because there is nothing to attract the negatively charged magnet. One goal of bed frame attachment 807 is to hold the magnet in place and ensure that there is a mechanism that attracts the negatively charged magnet and forces the overlay to move. Bed frame attachment 807 preferably comprises magnet with positive pole 804, positive magnet holding straps 805, and finally positive magnet cover 806. Magnetism system 808 comprises bed frame attachment 807 and patient underlay 803.

Figure 11:
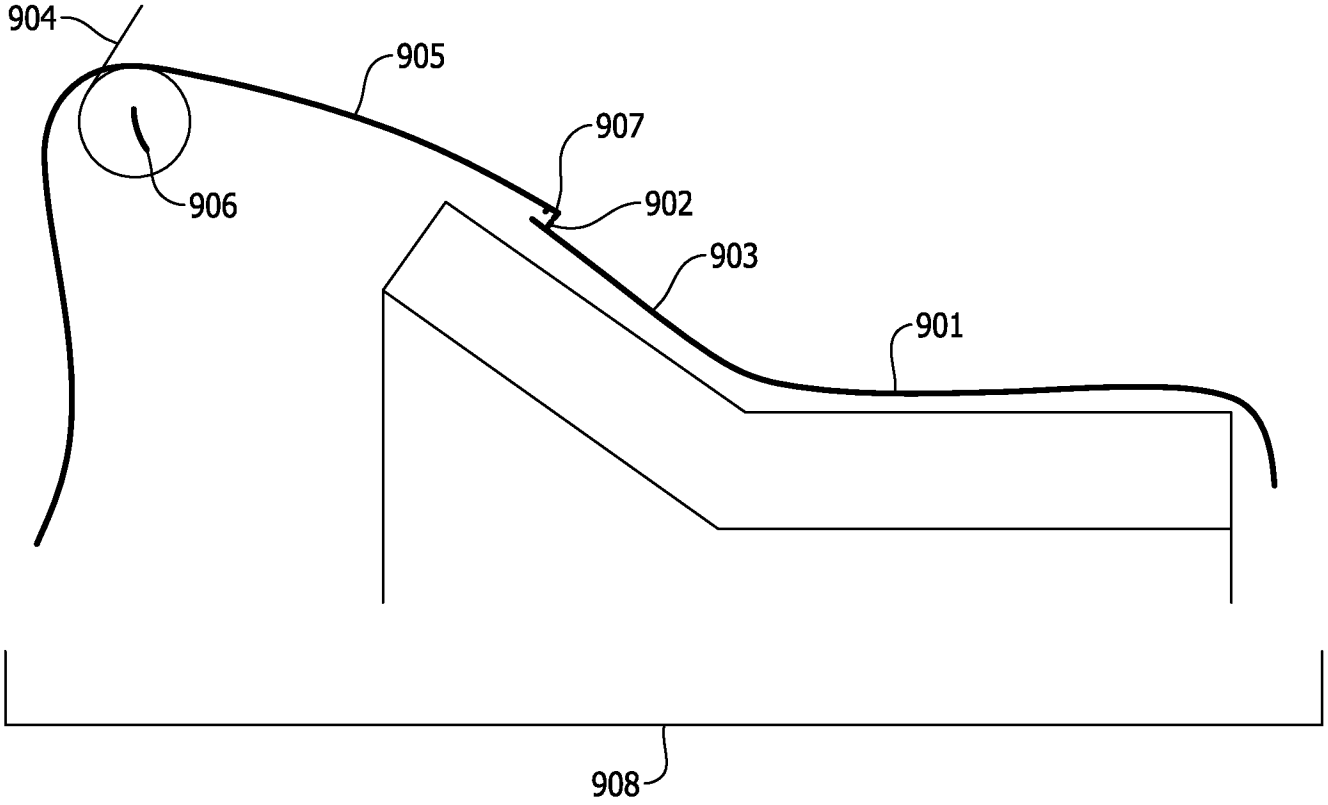
FIG. 11 is a perspective view, which shows a perspective view of a pulley system and its related components.

FIG. 11 is a perspective view, which shows a perspective view of a pulley system 900 and its related components. Pulley overlay material 901 comprises a fabric that lies underneath the patient and it pulls the patient upwards. This happens because when the pulley and ropes move the material up, the patient moves with it. Pulley overlay material 901 interacts with multiple items: First, pulley overlay material 901 interacts with the patient. Next, it interacts with the bed. Next, it interacts with the hook holes. Finally, it interacts with the hooks. Pulley overlay material 901 is attached to the hooks which go through it and help to pull it upwards. Spatially, pulley overlay material 901 is preferably positioned above the mattress cover on the hospital bed, and below the patient.

Pulley overlay material 901 is mainly thought to be composed of an antimicrobial fabric that is widely used in hospitals; however other embodiments may be composed of any of the following: cotton, linen, wool, or polyester blend. In some embodiments, it is thought that an example of pulley overlay material 901 may include any fabric that is washable and sanitizable and the like. In some embodiments, it is thought that if pulley overlay material 901 is absent then the invention no longer works, because there is nothing that holds the patient and pulls it upwards. One goal of pulley overlay material 901 is to be the material that holds the patient and moves the patient, because when the material moves, the patient moves along with it.

Pulley overlay hook holes 902 comprises small circles that go down one side of the overlay material, that allow for hooks to attach into it. Pulley overlay hook holes 902 interact with a couple of things: It interacts with the hooks of the overhead portion of the overlay and it also interacts with the material of the mattress overlay. Spatially, pulley overlay hook holes 902 is preferably positioned along one side of the overlay material, facing the head of the bed. Pulley overlay hook holes 902 is mainly thought to be composed of for the hook holes to be surrounded by metal, so the material does not continue to wear down.

In some embodiments, it is thought that an example of pulley overlay hook holes 902 may include small metal loops that protrude from the overlay and the like. In some embodiments, it is thought that if pulley overlay hook holes 902 is absent then the hooks have nothing to attach to, and therefore the pulley has nothing to actually pull up. As a result, the invention does not work, because the patient cannot be repositioned on the incline bed. One goal of pulley overlay hook holes 902 is to provide the space that the hooks attach to, so the overlay material can be pulled up by the pulley system.

Pulley overlay 903 comprises the combination of the material and hook holes, and it's the part of the invention that holds the patient and helps to move them. Pulley overlay 903 interacts with multiple items: First, pulley overlay 903 interacts with the patient. Next, it interacts with the hooks. Finally, it interacts with the mattress cover. Pulley overlay 903 is attached to the hooks, and as such, the pulley system. Spatially, pulley overlay 903 is preferably positioned underneath the patient on the incline bed, but above the mattress cover. Pulley overlay 903 is mainly thought to be composed of an antimicrobial fabric widely used in hospitals; however other embodiments may be composed of any of the following: cotton, linen, wool, or polyester blend. In some embodiments, it is thought that if pulley overlay 903 is absent then there is no mechanism by which the person is pulled upwards in the hospital bed, so the invention no longer works. One goal of pulley overlay 903 is to be the part on which the patient rests, and the part that helps the patient move upwards on the incline bed. Pulley overlay 903 comprises pulley overlay material 901 and pulley overlay hook holes 902.

Pulley overhead 904 comprises the combination of the pulley, the ropes, and the hooks, all working together to be the overhead mechanism by which the user/caregiver can engage the pulley system and move the overlay upwards, and reposition the patient along with it. Pulley overhead 904 interacts with multiple items: First, pulley overhead 904 interacts with the ceiling. Next, it interacts with the overlay. Finally, it interacts with the user/caregiver. Pulley overhead 904 is attached to the ceiling so that it can be easily used, part of it is attached to the overlay so that the overlay can be pulled up, and part of it is attached to a wall hook so that the rope in the overhead system doesn't move out of place. Spatially, pulley overhead 904 is preferably positioned behind the head of the incline bed, attached to the ceiling for easy use and access to patient or caregiver.

In some embodiments, it is thought that an example of pulley overhead 904 may include an automated pulley system instead of a manual one and the like. In some embodiments, it is thought that if pulley overhead 904 is absent then a critical part of the invention is missing, because the entire system that moves it is no longer present. The invention would no longer function. One goal of pulley overhead 904 is to provide the mechanism by which the entire system is operated, and allow the process for holding/repositioning a patient on an incline bed to be engaged and the overlay to be pulled up. Pulley overhead 904 preferably comprises pulley ropes 905; rope hooks 907, and finally pulley 906.

Pulley ropes 905 comprises a length of strong cord made by twisting together strands of fiber, used as part of the pulley system to connect the overlay and overhead systems together, as well as the part by which the user engages the pulley and causes it to move. Pulley ropes 905 interact with multiple items: First, pulley ropes 905 interact with the user/person that is operating the pulley system. Next, it interacts with the pulley(s). Finally, it interacts with the hooks. Pulley ropes 905 are attached to the pulley system, the hooks, and a wall hook, which is not part of the invention, but is the place where the ropes are held in place. Spatially, pulley ropes 905 is preferably positioned through the pulley, with strands that head towards the bed and has a hook attached on one end. The part of the rope that goes through the other end of the pulley, away from the incline bed and the part that is actually pulled, hangs down and is held in place by a wall hook.

Pulley ropes 905 is mainly thought to be composed of polypropylene, however other embodiments may be composed of any of the following: metal, nylon, hemp, polyester, or manila. In some embodiments, it is thought that if pulley ropes 905 are absent then there is nothing that goes into the pulley system, so the user has nothing to pull to engage the pulley system, and there is nothing holding the hooks and allowing them to connect to the overlay. Because the ropes are the part of the invention that allows the pulley to work, the invention cannot function without it. One goal of pulley ropes 905 is to allow the pulley system to work, to be pulled in order to move the overlay upwards on the incline bed, and to hold the hooks which hook onto the overlay.

Pulley 906 comprises a wheel with a grooved rim around which a cord passes. Pulley 906 interacts with a couple of things: It interacts with the ceiling and it also interacts with the ropes. Pulley 906 is attached to the ceiling, which is not part of this invention but the pulley attaches there so there is a convenient place for a nurse or caregiver to engage the pulley. Spatially, pulley 906 is preferably positioned on the ceiling behind the head of the hospital bed, with rope going through the pulley.

Pulley 906 is mainly thought to be composed of metal; however other embodiments may be composed of any of the following: stainless steel, plastic, glass, or wood. In some embodiments, it is thought that if pulley 906 is absent then there is nothing for the ropes to go into, and nothing that disperses the weight of the patient on an incline bed. Without the pulley, a person operating the invention could just pull the rope themselves, but it would be significantly harder to do. One goal of pulley 906 is to distribute the weight of the patient on the incline bed and make it easier for a nurse or caregiver to hold/reposition a patient on an incline bed.

Rope hooks 907 comprise small hooks that are attached to the ropes, and they connect to the overlay to help pull it up. Rope hooks 907 interact with multiple items: First, rope hooks 907 interact with the pulley system. Next, it interacts with the ropes. Next, it interacts with the hook holes. Finally, it interacts with the overlay. Rope hooks 907 are attached to the ropes which connect to the pulley system and the hook holes. Spatially, rope hooks 907 is preferably positioned are connected to the ropes which stretch out from the pulley system. The hooks stretch on the rope and hook into the hook holes, which are along the width of the upper side of the overlay material.

Rope hooks 907 is preferably shaped like an elongated c shape so the hook can easily connect to the hook holes/overlay, but the elongation ensures that the hooks do not fall out however, it is thought that in alternative embodiments that it may also be shaped like a circle with a small lever that allows a portion of it to open up and connect into the hook holes or alternately an o-shape that comes and is built into the hook holes, so that it cannot be attached or detached. Rope hooks 907 are mainly thought to be composed of metal, however other embodiments may be composed of any of the following: wood, stainless steel, glass, or plastic. In some embodiments, it is thought that if rope hooks 907 are absent then there is nothing to connect the overhead system with the pulley to the overlay, and as a result the overlay will not be pulled upwards. The patient will not move upwards if the overlay does not move, so the process for holding/repositioning a patient on an incline bed is not fulfilled and so the invention does not work. One goal of rope hooks 907 is to provide the means by which the pulley system connects to the overlay and pulls it up. Pulley system 908 comprises pulley overlay 903 and pulley overhead 904.

Figure 12:
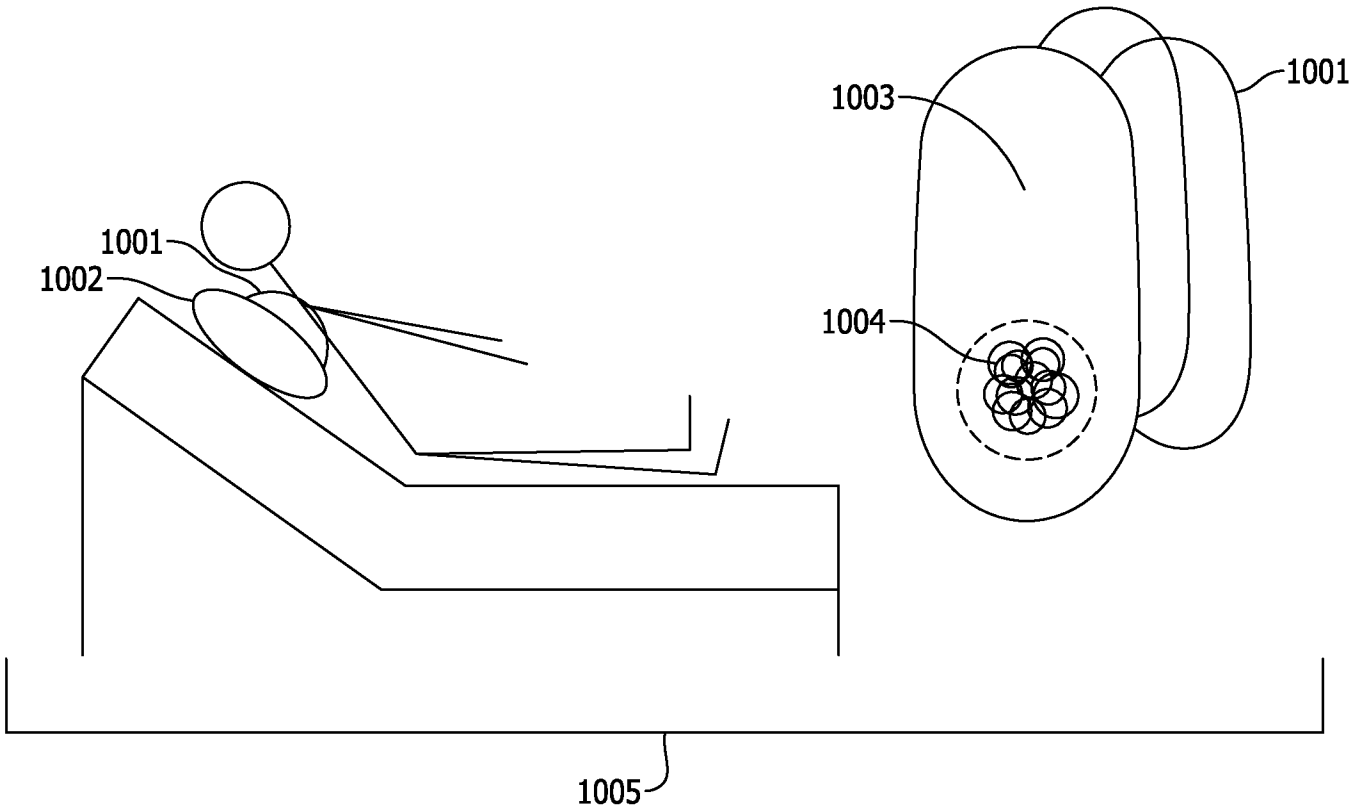
FIG. 12 is a perspective view, which shows a perspective view of a backpack method and its related components.

FIG. 12 is a perspective view, which shows a perspective view of a backpack system 1000 and its related components. Backpack straps 1001 comprises strips of fabric that attach to the fabric pack and allow the patient to wear the fabric pack as if it was a backpack, because the straps go over the arms and hold it in place. Backpack straps 1001 interacts with a couple of things: It interacts with the patient and it also interacts with the fabric pack. Backpack straps 1001 is attached to the top and bottom of the fabric pack. Spatially, backpack straps 1001 is preferably positioned there are two straps, one on each side of the fabric pack. The straps connect to the top far right and left parts of space on the fabric, and the respective bottom parts of space.

Backpack straps 1001 is mainly thought to be composed of nylon, however other embodiments may be composed of any of the following: polyurethane fabric, cotton, wool, linen, or silk. In some embodiments, it is thought that an example of backpack straps 1001 may include ropes that connect to the fabric pack and the like. In some embodiments, it is thought that if backpack straps 1001 are absent then there is nothing that allows the patient to wear the fabric pack, and as a result, the fabric pack, which is meant to hold the patient in a safe position in an incline bed, is not held or fixed to the patient. This means that while the invention may still work if the fabric pack doesn't slide, it will not be effective. One goal of backpack straps 1001 is to provide a way for the fabric pack to be fixed to the user, so it does not move or slide away from them, allowing the fabric pack to serve its purpose.

Fabric pack 1002 comprises a combination of the stuffing and material which creates a backpack shaped fabric pack that goes behind the patient to hold them in an upright position. Fabric pack 1002 interacts with multiple items: First, fabric pack 1002 interacts with the straps. Next, it interacts with the patient. Finally, it interacts with the mattress cover. Fabric pack 1002 is attached to the straps. Spatially, fabric pack 1002 is preferably positioned the fabric pack is positioned behind the back of the patient and the inclined portion of the inclined bed so that the patient is propped up by the fabric pack.

Fabric pack 1002 is preferably shaped like rectangle; however, it is thought that in alternative embodiments that it may also be shaped like square, triangle, circle, or oval. Fabric pack 1002 is mainly thought to be composed of cotton, however other embodiments may be composed of any of the following: linen, nylon blend, wool, silk, or leather. In some embodiments, it is thought that an example of fabric pack 1002 could be multiple pillows stitched together or perhaps a full backpack and the like.

In some embodiments, it is thought that if fabric pack 1002 is absent then the invention cannot function because the mechanism that holds the patient in an upright position is gone. One goal of fabric pack 1002 is to hold the patient in an upright position on an incline bed by propping them up. Fabric pack 1002 comprises pack material 1003 and pack stuffing 1004.

Pack material 1003 comprises the fabric that wraps around the stuffing and holds it all in a compact space. Pack material 1003 interacts with multiple items: First, pack material 1003 interacts with the patient. Next, it interacts with the incline bed, which is not part of the invention but is necessary for the invention to work. Next, it interacts with the straps. Finally, it interacts with the stuffing. Pack material 1003 is attached to itself and Straps. Spatially, pack material 1003 is preferably positioned so that it forms a pocket where the stuffing can enter, then that gap is closed the material is then positioned so that it fits onto a person's back.

Pack material 1003 is preferably shaped like a rectangular shape; however, it is thought that in alternative embodiments that it may also be shaped like circular, an oval shape, a square, or a triangle. Pack material 1003 is mainly thought to be composed of cotton; however other embodiments may be composed of any of the following: nylon blend, linen, wool, silk, leather, or polyester blend. In some embodiments, it is thought that if pack material 1003 is absent then the invention doesn't work because there is nothing to hold the stuffing in, and as a result the entire invention falls apart. One goal of pack material 1003 is to hold the stuffing in place so the patients back can be propped up when they are lying down it also is the material by which the straps are connected.

Pack stuffing 1004 comprises a material filling that is comfortable for the patient and fills the material so the patients back can rest in a propped up in position. Pack stuffing 1004 interacts with the material. Spatially, pack stuffing 1004 is preferably positioned inside of the material rectangle, so that the rectangle is filled by the stuffing to full compacity. Pack stuffing 1004 is mainly thought to be composed of cotton however, it is thought that in alternate embodiments that the thing may also be composed of any material that is soft and does not capture heat. In some embodiments, it is thought that an example of pack stuffing 1004 may include any soft material that doesn't heat up easily, which can fill the space, much like the stuffing in a pillow and the like. In some embodiments, it is thought that if pack stuffing 1004 is absent then there is nothing to fill the material and nothing that props the patient up in bed, so the patient will not be held in the proper position on the incline bed and as such the invention no longer functions. One goal of pack stuffing 1004 is to fill up the material rectangle so the patients back is propped up in an upright position and then held there. Backpack method 1005 comprises backpack straps 1001 and fabric pack 1002.

Figure 13:
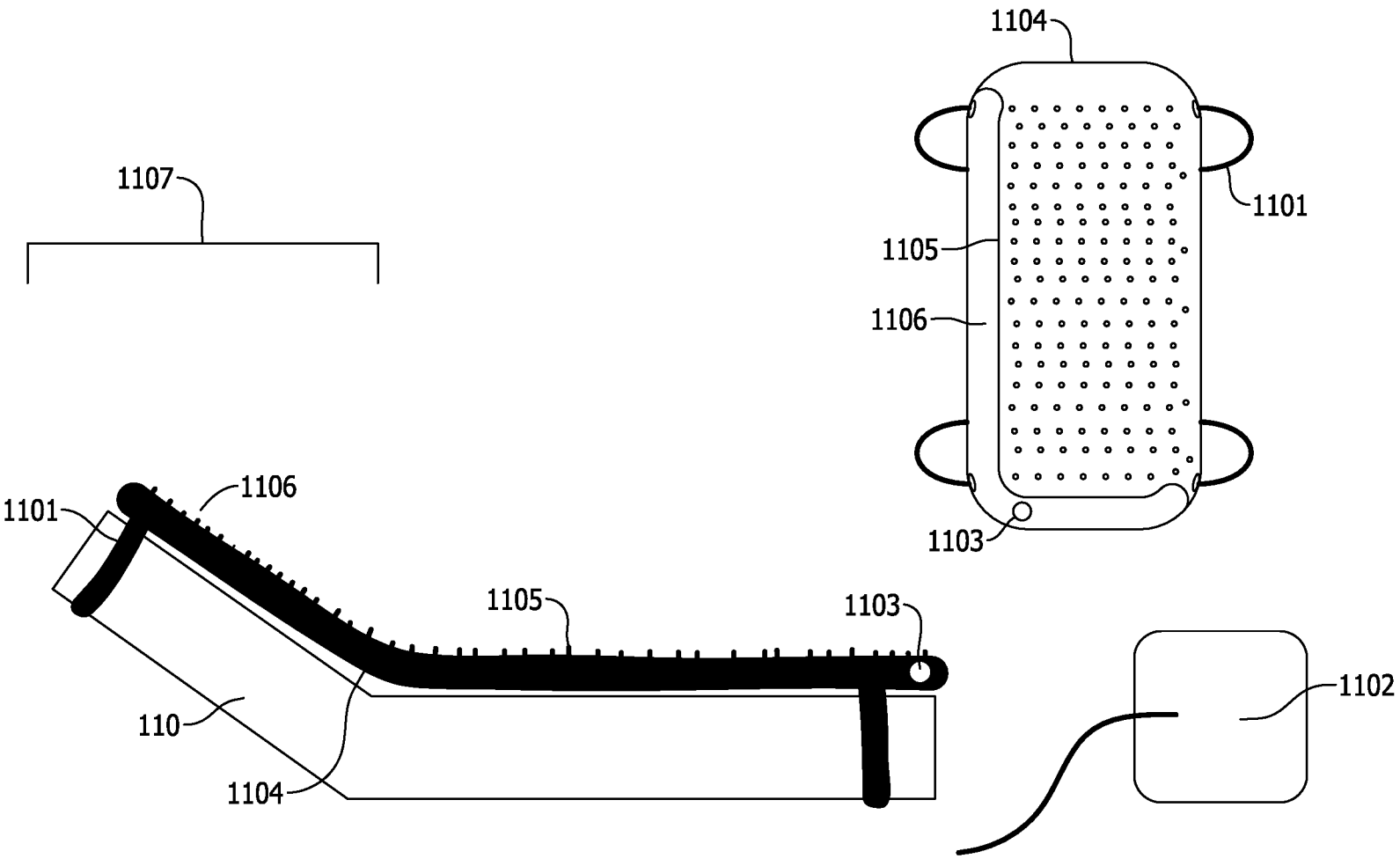
FIG. 13 is a perspective view, which shows a perspective view of a air lifting method and its related components.

FIG. 13 is a perspective view, which shows a perspective view of an air lifting system 1100 and its related components. Air pump 1102 comprises a device for pumping air into or out of an enclosed space. In some embodiments, it is thought that an example of air pump 1102 may include a human inflating the overlay pad with their own breath and the like.

Hole for air pump 1103 comprises a hole in the overlay pad which allows an air pump to be fitted onto it. Hole for air pump 1103 interacts with the air pump. Hole for air pump 1103 is attached to the air pump. Spatially, hole for air pump 1103 is preferably positioned on one of the bottom corners of the overlay pad, but anywhere on the side of the overlay pad works. In some embodiments, it is thought that if hole for air pump 1103 is absent then there is no way to pump air into the overlay pad, so the overlay pad will never inflate, and air will never be pushed out of the air blast pockets. This means the invention will not be able to work. One goal of hole for air pump 1103 is to allow air to be pumped into the overlay pad, so it can inflate and push out air, allowing a patient to be airlifted slightly and repositioned on the incline bed.

Air lift overlay pad 1104 comprises a thin pad, much like a blow up mattress, which can be inflated with air. Air lift overlay pad 1104 interacts with a couple of things: It interacts with air pump and it also interacts with patient. Spatially, air lift overlay pad 1104 is preferably positioned on top of the mattress cover on the incline bed, but underneath the patient. Air lift overlay pad 1104 is preferably shaped like a rectangular shape which could fit onto a standard size hospital bed.

Air lift overlay pad 1104 is mainly thought to be composed of textile-reinforced urethane plastic, however other embodiments maybe composed of any of the following: textile-reinforced urethane plastic, polyvinyl chloride, or rubber. In some embodiments, it is thought that if air lift overlay pad 1104 is absent then there is nothing for the air to be pumped into, and there is no way to build up pressure for the air that comes out of the air blast pockets, which means that the patient on the incline bed will not be affected at all, meaning the invention does not work. One goal of air lift overlay pad 1104 is to hold the air being pumped in and create pressure so when the air comes out of the air blast pumps; it has enough force to slightly lift the patient on the incline bed. It is not only what the patient will rest on but also the way that the patient is lifted. Air lift overlay pad 1104 preferably comprises air lift pad straps 1101.

Air blast pockets 1105 comprises small holes in the overlay pad which allow air to be released through them. Air blast pockets 1105 interacts with a couple of things: It interacts with the patient and it also interacts with the air/air pump. Spatially, air blast pockets 1105 is preferably positioned across the entire overlay pad, evenly distributed. Air blast pockets 1105 is preferably shaped like small circle holes in the overlay pad however, it is thought that in alternative embodiments that it may also be shaped like any small shape that allows air to be pushed out of the overlay pad. In some embodiments, it is thought that if air blast pockets 1105 are absent then the system simply becomes a higher tech version of an inflatable mattress. The invention would no longer work, because there are no air holes to pump out air that would lift the patient and allow them to be repositioned. One goal of air blast pockets 1105 is to allow air to be pushed out of the overlay pad with a higher degree of force than normal air, which can lift the patient on the incline bed slightly, allowing them to be moved easier.

Air lift overlay 1106 comprises the combination of the overlay pad, air blast holes, and air pump whole all working together to create an overlay that pumps air through the top, allowing the patient lying on it to be gently lifted. Air lift overlay 1106 interacts with a couple of things: It interacts with the patient and it also interacts with the incline bed. Spatially, air lift overlay 1106 is preferably positioned on top of the incline bed, and underneath the patient. The sides with the air blast pockets face upwards toward the patient.

Air lift overlay 1106 is mainly thought to be composed of textile-reinforced urethane plastic however in some embodiments; it is thought that in the thing may also be composed of polyvinyl chloride or alternately rubber. In some embodiments, it is thought that if air lift overlay 1106 is absent then the entire system fails to function because there is nothing that holds and pressurizes air and there is nothing for the patient to lie on, so the invention does not function. One goal of air lift overlay 1106 is to provide the mechanism by which the patient is lifted in their bed by air, and by doing so the patient is able to be repositioned on an incline bed far easier than current market solutions. Air lift overlay 1106 preferably comprises air blast pockets 1105, hole for air pump 1103, and finally air lift overlay pad 1104. Air lifting method 1107 preferably comprises air lift overlay 1106.

Although specific features of various implementations of the disclosure may be shown in some drawings and not in others, this is for convenience only. In accordance with the principles of the disclosure, any feature of a drawing may be referenced and/or claimed in combination with any feature of any other drawing.

This written description uses examples to disclose various implementations, which include the best mode, to enable any person skilled in the art to practice those implementations, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A patient positioning system for repositioning a patient with respect to a bed mattress supported by a frame, the patient positioning system comprising:

an overlay positioned between the patient and the bed mattress;

a roller configured to receive the overlay thereon;

a rotation mechanism coupled to said roller and configured to selectively rotate said roller to wind said overlay onto said roller; and a mounting assembly configured to mount said roller to the frame, wherein said mounting assembly comprises at least one clamp and at least one strap, wherein said at least one strap is configured to secure said at least one clamp to the frame.

2. The patient positioning system in accordance with claim 1, wherein said at least one clamp comprises: a U-shaped portion configured to be coupled the frame; and a ring portion configured to be coupled to said roller.

3. The patient positioning system in accordance with claim 1, further comprising an end cap coupled at distal end of said roller.

4. The patient positioning system in accordance with claim 1, further comprising a harness system configured to limit movement of the patient relative to the bed mattress, wherein the harness system comprises a flexible and stretchable member and a pad coupled to the member.

5. A patient positioning system for repositioning a patient with respect to a bed mattress supported by a frame, the patient positioning system comprising:

an overlay positioned between the patient and the bed mattress;

a roller configured to receive the overlay thereon;

a rotation mechanism coupled to said roller and configured to selectively rotate said roller to wind said overlay onto said roller, wherein said rotation mechanism comprises a manual crank assembly, wherein said mounting assembly comprises at least one clamp and at least one strap, wherein said at least one strap is configured to secure said at least one clamp to the frame.

6. The patient positioning system in accordance with claim 5, wherein said crank assembly comprises a rod with a first portion that extends from said roller and a second portion coupled to an end of said first portion.

7. The patient positioning system in accordance with claim 6, wherein said second portion extends in a direction away from overlay.

8. The patient positioning system in accordance with claim 6, wherein said rod is inserted into a cutout formed in said roller.

9. The patient positioning system in accordance with claim 6, further comprising a handle member coupled to said second portion.

10. A patient positioning system for repositioning a patient with respect to a bed mattress supported by a frame, the patient positioning system comprising:

an overlay positioned between the patient and the bed mattress;

a roller configured to receive the overlay thereon;

a motor coupled to said roller and configured to rotate said roller to wind said overlay onto said roller; and a sensor system electrically coupled to said motor and configured to control operation of said motor, wherein said sensor system is configured to determine when a patient has shifted relative to the bed mattress and activate said motor to rotate said roller and said overlay to bring the patient to proper position on the bed mattress.

11. The patient positioning system in accordance with claim 10, wherein said sensor system comprises a plurality of pressure sensors positioned between the bed mattress and said overlay.

12. The patient positioning system in accordance with claim 10, wherein said plurality of sensors are coupled to a strap that circumscribes the bed mattress.

13. The patient positioning system in accordance with claim 10, wherein said plurality of sensors comprises:

a first subset of sensors positioned at a first location between said overlay and the bed mattress; and a second subset of sensors positioned at a second location between said overlay and the bed mattress, wherein the second location is spaced from the first location.

14. The patient positioning system in accordance with claim 13, wherein the first location and the second location are based on a height of the patient.

15. The patient positioning system in accordance with claim 13, wherein said first subset of sensors and said second subset of sensors are distributed across the bed mattress at the first location and the second location, respectively.

16. A patient positioning system for repositioning a patient with respect to a bed mattress supported by a frame, the patient positioning system comprising:

an overlay positioned between the patient and the bed mattress;

a roller configured to receive the overlay thereon;

a motor coupled to said roller and configured to rotate said roller to wind said overlay onto said roller; and a sensor system electrically coupled to said motor and configured to control operation of said motor, wherein said sensor system comprises a plurality of pressure sensors positioned between the bed mattress and said overlay.

17. A patient positioning system for repositioning a patient with respect to a bed mattress supported by a frame, the patient positioning system comprising:

an overlay positioned between the patient and the bed mattress;

a roller configured to receive the overlay thereon;

a motor coupled to said roller and configured to rotate said roller to wind said overlay onto said roller; and a sensor system comprising a plurality of pressure sensors electrically coupled to said motor and configured to control operation of said motor, wherein said plurality of pressure sensors are coupled to a strap that circumscribes the bed mattress.

18. A patient positioning system for repositioning a patient with respect to a bed mattress supported by a frame, the patient positioning system comprising:

an overlay positioned between the patient and the bed mattress;

a roller configured to receive the overlay thereon;

a motor coupled to said roller and configured to rotate said roller to wind said overlay onto said roller; and a sensor system comprising a plurality of pressure sensors electrically coupled to said motor and configured to control operation of said motor, wherein said plurality of pressure sensors comprises:

a first subset of sensors positioned at a first location between said overlay and the bed mattress; and a second subset of sensors positioned at a second location between said overlay and the bed mattress, wherein the second location is spaced from the first location.

* * * * *